United States Patent [19]

Thiehofe

[11] 4,107,930

[45] Aug. 22, 1978

[54] METHOD AND APPARATUS FOR SINKING SHAFTS

[75] Inventor: Theodor Thiehofe, Essen, Fed. Rep. of Germany

[73] Assignee: Gewerkschaft Walter, Fed. Rep. of Germany

[21] Appl. No.: 720,096

[22] Filed: Sep. 2, 1976

[30] Foreign Application Priority Data

Oct. 7, 1975 [DE] Fed. Rep. of Germany ..... 2544834

[51] Int. Cl.[2] ..... E21D 1/06

[52] U.S. Cl. ..... 61/41 R; 61/85

[58] Field of Search ..... 61/41 R, 40, 85, 41 A

[56] References Cited

U.S. PATENT DOCUMENTS 3,386,253 6/1968 Henderson ..... 61/41 R

FOREIGN PATENT DOCUMENTS 380,723 10/1907 France ..... 61/41 R
1,140,888 12/1962 Fed. Rep. of Germany ..... 61/41 R
865,189 4/1961 United Kingdom ..... 61/41 R

*Primary Examiner*—Jacob Shapiro
*Attorney, Agent, or Firm*—McGlew and Tuttle

[57] ABSTRACT

A method of sinking a shaft, particularly in unstable ground, comprises driving an annular shield into the ground and controlling the sinking speed of the driving shield by varying the cross-sectional area of the shield, and lining the excavated shaft behind the shield as it is advanced. An excavating device for forming the vertical shaft comprises an annular driving shield which is displaceable relative to an annular platform by fluid pressure operated piston and cylinder jacks connected therebetween. The structure includes an annular shield tail which is connected to the shield and extends rearwardly of the shield and the platform and the shield itself is provided with an inwardly directed taper and has prop means associated therewith for varying the affective taper and the affective cross-sectional area of the shield. The excavated shaft is lined behind the shield and the tail portion thereof as the shield is advanced. An annular machine platform is braced against the lining by telescopically movable braces which are fluid pressure driven to engage against the lining.

9 Claims, 3 Drawing Figures

METHOD AND APPARATUS FOR SINKING SHAFTS

FIELD AND BACKGROUND OF THE INVENTION

The present invention relates to a method and apparatus for sinking shafts and, in particular, to a new and useful method and apparatus for sinking shafts in unstable grounds. By unstable ground is meant primarily a non-cohesive ground, such as a runningground, that is, a water-bearing formation with flowing zones.

DESCRIPTION OF THE PRIOR ART

In stable grounds, as a rule, the sinking of shafts is carried out by drilling, blasting and landing and the following support is established intermittently. For sinking shafts in an unstable ground, either a shaft boring, a sunk shaft, or a consolidated method may be used. In the shaft boring method, as the designation suggests, the excavation is effected by boring. As a rule, either the rotary method or the Honigmann method are used. By flushing, counteracting the hydrostatic and rock pressure, the walls of the shaft are supported so that the lining can be packed and cemented as a closed cylinder (mostly steel).

In the sunk shaft method, the excavation is effected by mucking or mechanical shoveling from the shaft bottom, and frequently, the caisson method is used to this end. The finished shaft lining which, on its lower end, is provided with a cutting shoe of steel, sinks by its own weight or under additional load. Following the sinking, a lining tube is installed underground and is extended in accordance with the progressing sinking.

The consolidation methods are based on the fact that unstable, usually water-bearing grounds, must be consolidated before the shaft-sinking work can be started. The ground may be consolidated by freezing or by cementation or chemical injections. Within certain limits, the ground water lowering methods may also be considered as belonging in this category.

SUMMARY OF THE INVENTION

The present invention provides a method for making it possible to sink shafts, particularly in an unstable ground, rapidly and securely and in a relatively simple and economical manner.

In accordance with the invention, the work is accomplished in a shield-tunneling technique by driving a cylindrical advancing shield in a vertical position and with the shield front end open into the ground. As the shield is driven, the free cross-sectional area of the shield is varied as a function of the nature and consistency of the zone to be traversed in order to control the sinking speed of the advancing shield. As the shield is advanced, the lining of the shaft is carried out in a zone of the shield tail or trailing portion. Up to date, the shield driving has been known only in the construction of tunnels in running grounds, where a circular steel cylinder is hydraulically driven into the ground. Under the protection of the driving shield, the excavation and lining is effected. The invention is based on the finding that the shield driving can also be used for sinking shafts, however, only under the condition that a control of the sinking speed in the flowing zones to be traversed is provided. In this connection, sinking refers to the vertical penetration of the driving shield into the ground due only to its own weight without the operation of driving jacks. However, driving jacks may support the penetration of the driving shield into the ground, and in more solid zones, they provide for the driving power to a greater extent. A too high sinking speed in flowing zones results in a too strong penetration of the non-cohesive earth into the driving shield and, thereby, in an excessive escape of the ground or even of the backfilling which is already brought in from behind the shield or the following lining. Then there is a danger of flooding the shaft. In accordance with the invention, this danger is eliminated by providing that the sinking speed of the driving shield is controlled by reducing or enlarging the open cross-sectional area of the shield in accordance with the actual conditions of the ground. The lining of the shaft, linking up with the shield tail which may partly overlap the lining from the outside, may comprise, in the usual manner, a concrete or brick wall or tubings or steel segments. By stacking tubings, for example, a closed watertight column is formed which finally may be back-filled with concrete or, for example, with a suspension under pressure.

A further aspect of the invention is the provision of a device for sinking vertical shafts which includes an annular shield with a supporting platform having driving means for advancing a shield and which includes a shield tail seal which extends rearwardly of the platform and which is disposed so as to permit the erection of a lining within the seal extending rearwardly upwardly from the driving shield. The apparatus permits the driving of the shield for the purpose of sinking the shaft even in loose, water-bearing ground, which would otherwise require relatively expensive freezing methods.

In a preferred embodiment of the invention, the operating platform is equipped with a bottom ring which is mounted adjacent the cylindrical driving shield and has an upwardly conically converging shape to provide a propping means associated with the shield to vary the effective cross-section of the shield operating to cut away the shaft. This propping mechanism ensures that the driving shield will be propped against penetration into the earth at a faster rate when it becomes apparent that the shaft is sinking faster than a preferred operational rate, due to its own weight. In this manner, the sinking speed is controlled automatically. This controlling effect can be increased by providing propping plates which may be inserted in the driving shield for forming a bottom ring which has a central passage opening which reduces the cross-section of the opening left by the shield alone. This construction is provided preferably in cases where particularly loose flowing zones are to be traversed. The propping plates may be connectable to the operating platform, preferably below the platform. The propping plates form a bottom ring which is positioned in a cross-sectional plane of the driving shield, or it may be installed in a slightly conical position. How strongly the penetration of the running earth into the driving shield is braked and finally prevented depends on the angle of adjustment. The same applies to the conicity of the bottom ring which is formed by the operating platform.

In accordance with the invention, the machine platform is advantageously designed as a ring platform which is braced against the lining of the shaft by means of a piston-cylinder drive member. The machine platform serves the purpose of supporting hydraulic equipment, electrical switch cabinets, and as a structure for supporting an excavator. The operating platform is also a ring platform so as to permit work in the center of the driving shield and the removal, loading and hoisting of the earth in the zone of the shield front.

The inventive method makes it possible to sink shafts, particularly in non-cohesive grounds, in a particularly simple and economical manner. Experience has shown that the shield driving method which is otherwise known for tunneling can be employed also for sinking shafts and even in instances where running ground with extremely flowing zones must be traversed. In all cases, the sinking speed, as well as the driving speed, can be controlled so that the flooding of the shaft bottom is avoided. In addition, the work can be accomplished with the inventive shield driving method in a particularly rapid and secure manner.

Accordingly, an object of the invention is to provide a method of sinking shafts, particularly in unstable grounds, which comprises positioning an annular shield into the ground to be excavated with its axis substantially vertical and with its open front oriented in the ground and advancing the shield into the ground, and controlling the advancing speed of the shield by varying the cross-sectional area of the shield, and removing the ground that has been won by the shield to form an excavated shaft, and lining the excavated shaft behind the shield as it is advanced.

A further object of the invention is to provide an excavating device which includes an annular driving shield, an annular platform located within and rearwardly of the driving shield which has fluid pressure operated piston and cylinder jacks connected between the platform and the shield for advancing the shield downwardly into the ground and which further includes an annular shield tail extending upwardly from the platform which is adapted to be disposed inwardly of a lining applied to the excavated shaft and which also includes pumping plate means associated with the shield for varying the effective area of the shield which is acting against the ground face.

A further object of the invention is to provide an apparatus for sinking shafts which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and description matter in which there is illustrated a preferred embodiment of the invention.

DESCRIPTION OF THE PREFERRED EMBODIMENTS

Figure 1:
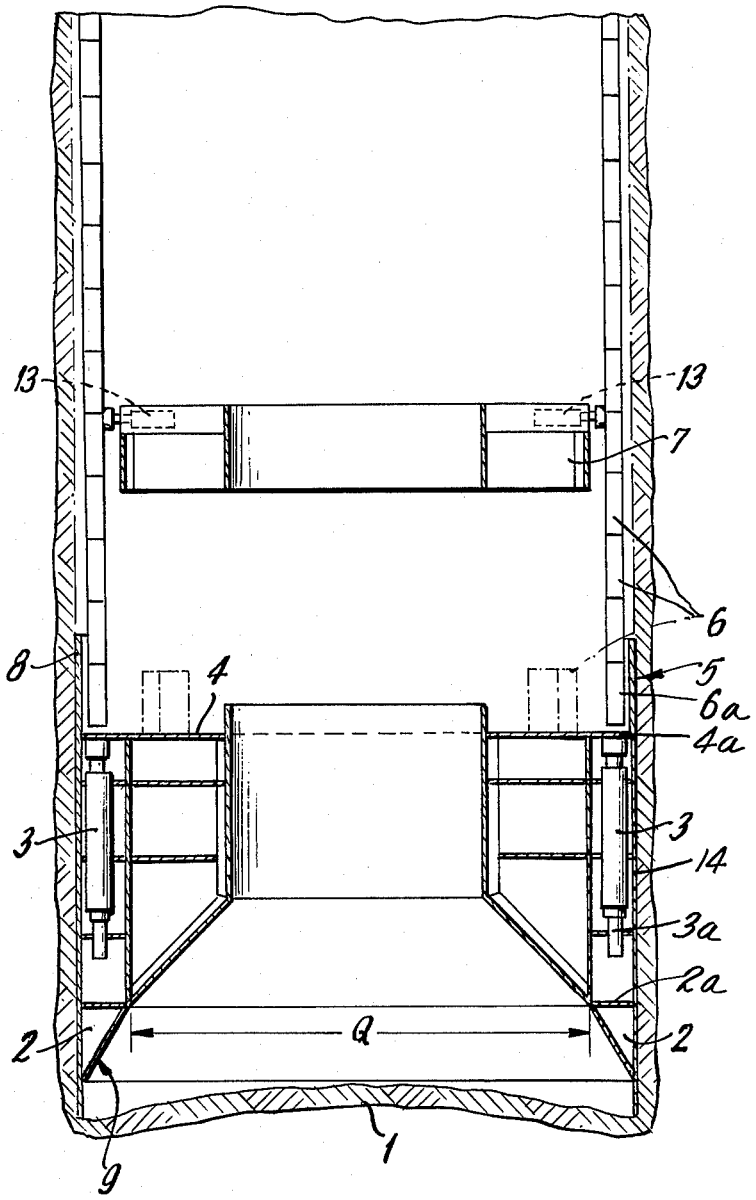
FIG. 1 is a partial cross-sectional view of a shaft excavating device constructed in accordance with the invention.

Each of the Figures shows substantially identical devices and therefore the parts of each have been similarly numbered. In the embodiment shown in FIG. 1, which is employed for relatively solid ground 1, an excavating device for sinking a vertical shaft into the ground includes a driving shield 2, which is connected through driving jacks 3 to an annular platform 4. The shield 2 is arranged outside of the portions of the platform and is telescopic in respect to a lower portion thereof and it may be driven downwardly into the ground by operating the jacks 3. The inventive arrangement includes a shield tail seal 5 which extends rearwardly of the operating platform 4 and which seals the shaft until the lining 6 is applied during the forward movement of the driving shield 2.

The construction of the invention also includes a machine platform 7 which is intermittently lowered within the lining 6 of the shaft. Driving jacks 3 and the holding elements 13 for the machine platform 7 are all fluid pressure operated piston and cylinder units which are advantageously hydraulic.

Lining 6 may comprise, for example, tubings or interconnecting elements, such as brickwork, which are formed as the shaft progresses.

In the hard ground method, a shielding method is used in which driving shield 2, arranged in a vertical position, with its end oriented in the ground 1 and with its front open as it is driven into the ground. The free cross-sectional space Q representing the size of the excavation at the level of the innermost taper portion of shield 2 can be reduced or enlarged as a function of the nature and consistency of the ground 1 to be penetrated. The shield 2 itself may be permitted to penetrate into the ground by its own weight and the sinking speed may be controlled entirely or partly by the cross-sectional area of the effective driving shield 2. During, or slightly after the shield 2 penetrates the ground, a lining 6 is installed in the zone of the shield tail 8 which embraces the last installed tubings of the lining 6. Lining 6 is then back-filled in the present example with a suspension under pressure.

Figure 2:
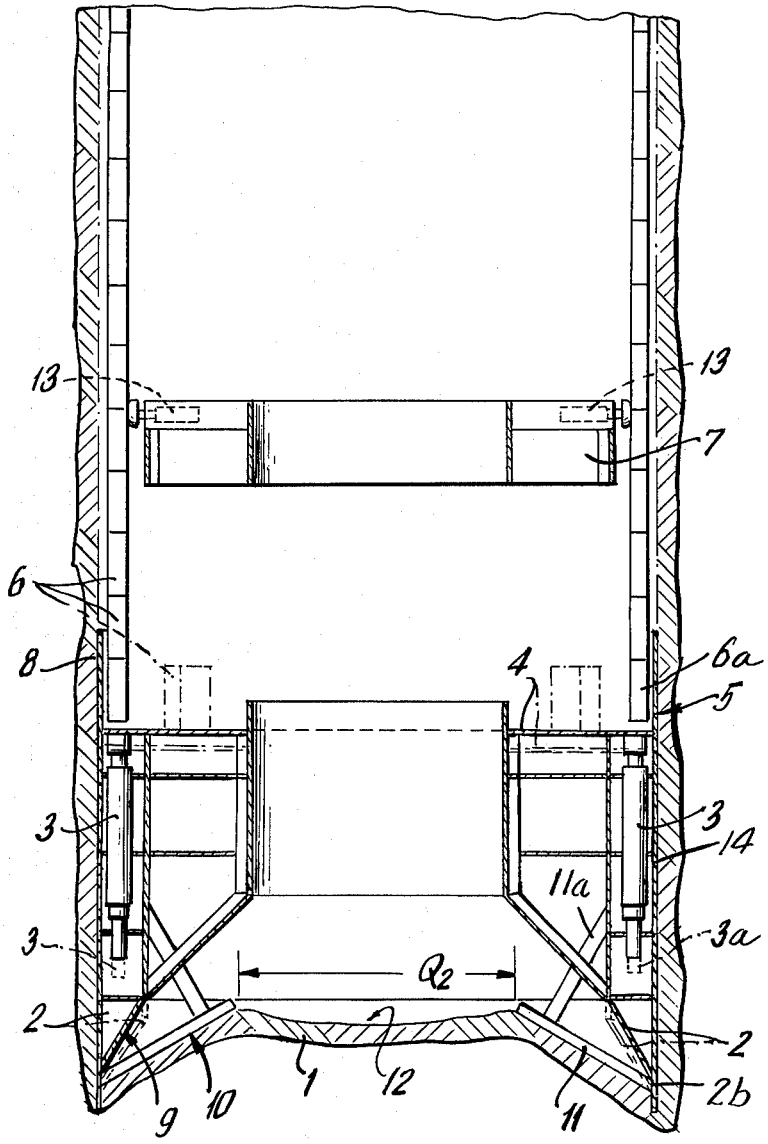
FIG. 2 is a view similar to FIG. 1 indicating the device used in ground which is non-cohesive but which is very soft.
Figure 3:
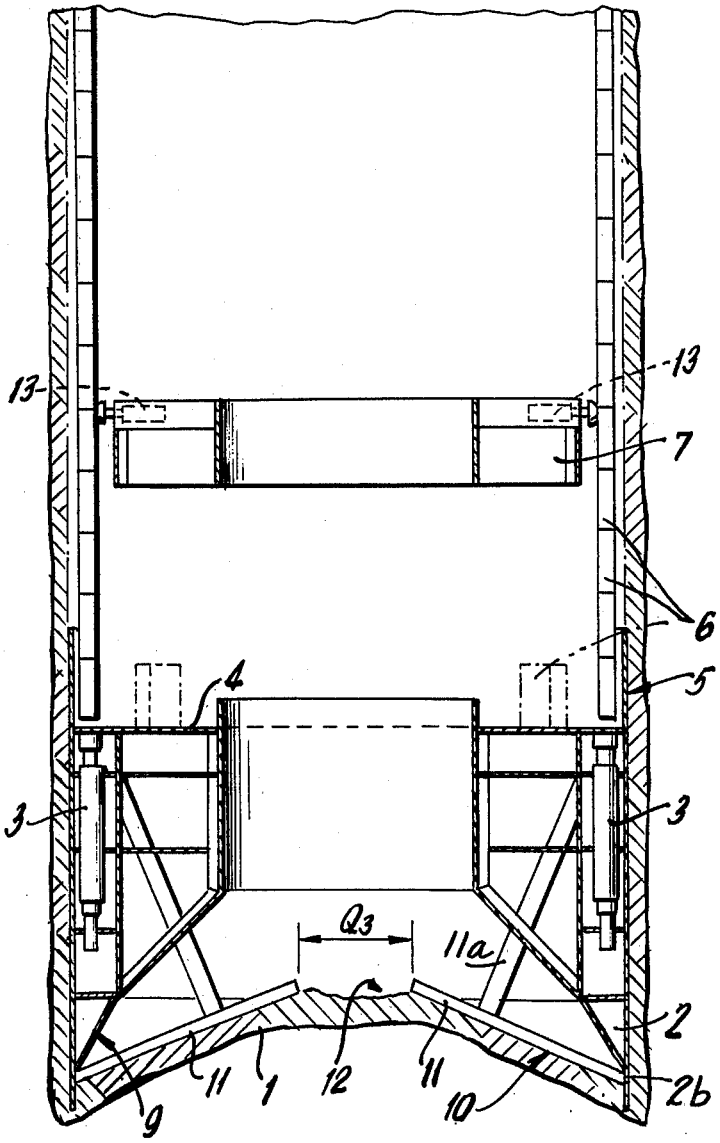
FIG. 3 is a view similar to FIG. 1 showing the assembly when penetrating extremely flowing zones and a running ground.

The operating platform 4 which is a ring platform is equipped with a bottom ring 10, as shown in FIGS. 2 and 3, which is mounted adjacent the cylindrical driving shield 2 at the location of the conical cutting surface 9. The conical cutting surface 9 has an inwardly converging conical shape reducing the free cross-section of the shield to an opening $Q_2$. This converging shape permits limited penetration of the earth and the greater the amount of penetration, the smaller the area of penetration of the driving shield. The extension of the bottom ring 10 provides for a gradual hingering and lessening of the rate of penetration into the ground 1. The prop means 11 are in the form of individual propping plates which may be inserted into the shield 2 to form a bottom ring having a passage opening 12 which can be reduced to any desired degree. Propping plates 11 are advantageously screwed to the platform 4 at the bottom end thereof.

The machine platform 7 which is also designed as a ring platform can be braced against the lining 6 of the shaft by means of the piston cylinder units 13. Platform 7 provides a means for supporting hydraulic equipment, electrical switching devices, an excavator, the concrete feed equipment, pumping stations, etc.

FIGS. 2 and 3 show views with the prop means 11 extended partially, as shown in FIG. 2, and substantially fully, as shown in FIG. 3, so as to reduce the free ground area from the value Q shown in FIG. 1 to $Q_2$ shown in FIG. 2, and $Q_3$ shown in FIG. 3.

In operation the driving shield 2 which is connected to an annular shield shell 14, sinks into the ground 1 by virtue of its own weight when the ground is sufficiently unstable to allow for such movement. In firmer areas the jack 3 is actuated which extends the ram 3*a* into abutment with the top surface 2*a* of the driving shield 2. The other end of the jack 3 abuts against platform 4 and 4*a* and in turn is displaced against the bottom liner segment 6*a* of the column of liners 6. Due to the frictional contact and back filling between the liners 6 and the earth therearound, the driving shield 2 is forced downwardly into the soft ground 1 by the action of the jack 3. Driving shield 2 with its top portion 2*a*, shield shell 14 and shield tail seal 5 move as a unit in sliding relationship to platform 4 when jack 3 is activated to press driving shield 2 down into the earth 1. Further, prop 11 is connected to the driving shield 2 at 2*b*, and extends toward the center of the shaft to reduce the free opening Q to the reduced sizes $Q_2$ and $Q_3$ of respective FIGS. 2 and 3. Prop 11 thus moves with the driving shield 2 and resists the movement of the driving shield 2 through the ground 1 when ground 1 is of an unstable and flowing nature, so as to reduce the speed of the driving shield 2 through the ground in this area. It will be understood that through this unstable and flowing ground the jack 3 is unnecessary for moving the shield 2 inasmuch as the shield 2 will move through the ground in this area by virtue of its weight alone. In addition, the size of the opening Q can be varied by providing props 11 of different sizes or by providing a prop 11 which is pivotably connected to the end 2*b* of the driving shield 2. Support 11*a* can further be provided for supporting the prop 11 in its desired position.

While specific embodiments of the invention have been shown and described in detail to illustrate the application of the principles of the invention, it will be understood that the invention may be embodied otherwise without departing from such principles.

What is claimed is:

1. A method of sinking shafts particularly in unstable ground, comprising placing an open ended annular shield in a vertical position with its open end positioned into the ground and advancing the shield into the ground, controlling the advancing speed of the driving shield by varying the size of the opening within of the shield to reduce the speed with reduction in the opening area and as a function of the nature of the ground, and lining the excavated shaft behind the shield as it is advanced.

2. A method of sinking shafts, particularly in unstable ground, according to claim 1, including backfilling the lining between the lining and the shaft which is formed with a suspension under pressure.

3. A method of sinking shafts, particularly in unstable ground, according to claim 1, wherein the cross-sectional area of the shield is varied by the construction of the shield so that it converges inwardly from its bottom end.

4. A method of sinking shafts, particularly in unstable ground, according to claim 1, wherein the cross-section of the shield is varied by extending props pivotally upwardly and inwardly from the tip of the shield to extend inwardly therefrom.

5. An excavating device for sinking vertical shafts, comprising an annular driving shield, an annular platform, fluid pressure operated piston and cylinder jacks connected between said platform and said driving shield for the driving advance of the shield downwardly from said platform, an annular shield tail connected to said platform and extending upwardly from said platform, said shield being shaped with an inwardly and upwardly extending taper at its lower end so as to define a gradually increasing cross-section which penetrates into the ground, and an annular platform having means for permitting engagement and release thereof for positioning so as to follow the platform and shield into the excavation, the excavating device further including propping means associated with said driving shield which are extensible outwardly from a tip thereof to widen the effective area of ground penetration.

6. An excavating device, according to claim 5, wherein said platform comprises a ring and propping plate means associated with said ring and being mounted adjacent the bottom end of said shield for raising and lowering toward the center of said shield so as to increase and decrease the cross-section thereof.

7. An excavating device, according to claim 5, including propping plate means associated with said shield forming an inwardly converging ring adjacent the bottom tip of said shield having a central passage opening which may be varied so as to reduce the effective cross-section of said ring.

8. An excavating device, according to claim 7, wherein said propping means are connected to said platform.

9. An excavating device, according to claim 8, including a ring-shaped machine platform adapted to be arranged above said annular platform and having fluid-pressure operated piston and cylinder assemblies which are extensible and retractable to brace the platform in the excavation.

* * * * *